United States Patent [19]

Wendell

[11] 4,386,678

[45] Jun. 7, 1983

[54] COLLAPSIBLE WORK SUPPORT

[76] Inventor: John R. Wendell, 1304 Riddle St., Gowrie, Iowa 50543

[21] Appl. No.: 292,827

[22] Filed: Aug. 14, 1981

[51] Int. Cl.[3] ..... B27B 21/00

[52] U.S. Cl. ..... 182/182; 182/151; 182/185; 182/225

[58] Field of Search ..... 182/181–186, 182/224–226, 178, 179, 151

[56] References Cited

U.S. PATENT DOCUMENTS

| | | | |
|---|---|---|---|
| Re. 30,020 | 6/1979 | Spencer | 182/182 |
| 652,517 | 6/1900 | Laurent | 182/182 |
| 892,218 | 6/1908 | Brumberg et al. | 182/182 |
| 926,320 | 6/1909 | Croner | 182/182 |
| 2,410,330 | 10/1946 | Ashenfelter | 182/182 |
| 2,534,682 | 12/1950 | Robishaw | 182/182 |
| 3,763,958 | 10/1973 | Hanson | 182/181 |
| 3,934,676 | 1/1976 | Rice | 182/182 |

FOREIGN PATENT DOCUMENTS

| | | | |
|---|---|---|---|
| 72550 | 5/1951 | Denmark | 182/181 |

*Primary Examiner*—Reinaldo P. Machado

*Attorney, Agent, or Firm*—Zarley, McKee, Thomte, Voorhees & Sease

[57] ABSTRACT

A collapsible work support which is useful as a sawhorse, brackets for iron, wood or larger objects, and collapses for storage, all in a single plane, and therefore is readily adaptable to wall or cabinet storage. It is compact and ideally suited for crowded workshops and eliminates the need for bulky, awkward sawhorses and other stands.

4 Claims, 6 Drawing Figures

COLLAPSIBLE WORK SUPPORT

BACKGROUND OF THE DISCLOSURE

This invention relates to a collapsible work support device. In the present times, the amount of available space for hobby craft workrooms in the home is very limited. It is therefore often difficult to store in a small workroom such bulky and awkward items as sawhorses and other work stands. However, as those who engage in such home hobby craft "do it yourself" jobs well know, it is essential to often utilize sawhorses and other support stands in order to successfully complete a home workshop project.

While other home work support benches have been developed and utilized in the past, none of those are capable of collapsing to a structure which is storable in a single plane in a compacted fashion which when erected, will still provide adequate and solid support.

This invention has as its primary object filling the deficiencies of prior collapsible work supports mentioned in the above paragraph.

A more specific object is to provide a collapsible work support, especially adapted for use in home workshops where space is limited.

Another object is to provide not only a collapsible work support but one which is capable of collapsing and storage in a single plane, so that it takes a minimum of space.

Another object of the invention is to provide a light weight, portable, height adjustable, collapsible work support.

Yet another object of the invention is to provide a work support which assembles in seconds, and adjusts very quickly for varying heights.

An even further object is to provide a sturdy and solid collapsible work support which is capable with ease, of supporting in excess of 100 pounds, and which can be used not only for supporting wooden objects, but also pipe supports and the like.

A still further object is to provide a collapsible work support, capable of being stored in a single plane when collapsed, which will support not only wooden planks, but also has sufficient durability and strength to support metal shears, band saws, table saws, radial arm saws, and can be used as a bench extension.

An even further object is to provide a collapsible work support which readily adapts for wall storage or cabinet storage, all in a single plane.

The method and manner of accomplishing each of the above stated objectives, as well as others, will be apparent from the detailed description of the invention which will follow hereinafter.

SUMMARY OF THE INVENTION

A collapsible work support which comprises a large T-shaped frame member having a stem portion and a base portion with both the base and the stem of the T frame having open ends, defining elongated passageways. The T-shaped frame, adjacent each open end, has means to releaseably but securely grip any member which telescopes within it. The stem portion of the T has attached to two of its opposing sides, a pair of holding sleeves for releaseably holding other pieces of the collapsible work support. The device also has a pair of leg supports, each of which has a longer leg member and a shorter attaching member, with the attaching members being adapted to telescopically fit within the respective open ends of the base portion of the T-frame, and further with said longer leg members being adapted to slidably fit within said holding sleeves, and also having a top support member having a top support surface and an attaching short stem which is adapted to telescopically fit into the open end of said stem portion of said T-shaped frame.

When the structure is collapsed, the longer leg members of the leg supports are inserted into the respective sleeves and the top support member is completely telescoped within the open end of the T-shaped frame stem portion to provide a structure which substantially completely dwells in a single plane.

DETAILED DESCRIPTION OF THE INVENTION

Figure 2:
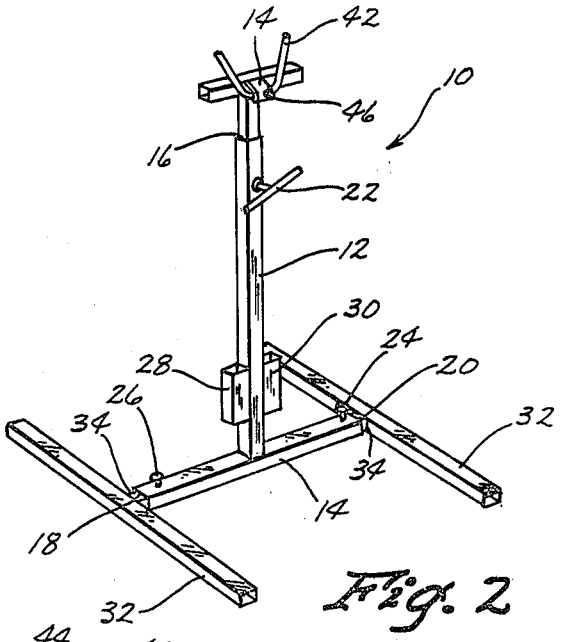
FIG. 2 is a perspective view of a single collapsible work support member in working position, ready for use.
Figure 3:
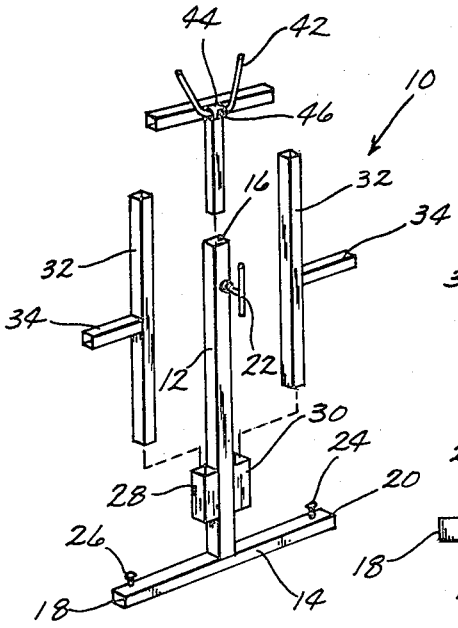
FIG. 3 shows an exploded view of the device illustrating how all of the members fit together to collapse the device in a single plane for easy storage.
Figure 4:
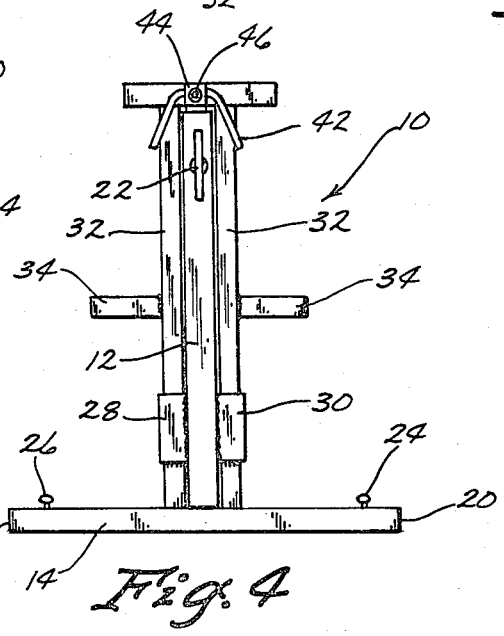
FIG. 4 shows the device in collapsed condition.

The collapsible work support device, referred to generally at 10, is illustrated in working position in FIG. 2, an exploded position in FIG. 3, and collapsed position in FIG. 4. The device 10 can be suitably made from square shaped hollow steel tubing. It is comprised of a T-shaped frame having a stem portion 12 and an adjoining base portion 14, with both the base and the stem of the T having open ends 16, 18 and 20, providing entrance to elongated internal passageways, not specifically numbered. Adjacent and near each opening 16, 18 and 20 are set screws 22, 24 and 26 which can be secured to grip any member which telescopes within the passageways, or conversely, unscrew to release any members which are telescoped within the passageways for which openings 16, 18 and 20 provide entrance.

The T-stem portion 12 has, attached to two of its opposing sides, a pair of holding sleeves 28 and 30 which may releaseably hold other pieces of said collapsible work support.

Also forming a part of the collapsible work support piece 10, are a pair of leg supports of like construction, each of which has a longer leg member 32 and positioned, roughly at the midpoint of longer leg 32, transverse to the longitudinal axis thereof, a shorter attaching member 34. The attaching members 34 are capable of telescopically fitting within the respective open ends 18 and 20 of the base portion 14 of the T-frame. The longer leg members 32 are adapted to slidably fit within holding sleeves 28 and 30.

Finally, the collapsible work support device 10 also has a top support member, referred to generally at 36, which comprises a top support surface 38 and transverse to the longitudinal axis of top support surface 38 an attaching short stem 40. Attaching short stem 40 is adapted to telescopically fit into the open end 16 of the stem portion 12 of the T-shaped frame member.

Figure 1:
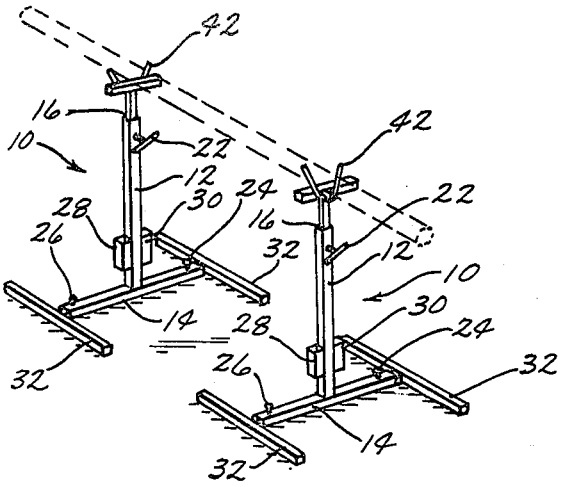
FIG. 1 is a perspective view showing two of the collapsible work support devices in working position for support of a pipe.
Figure 5:
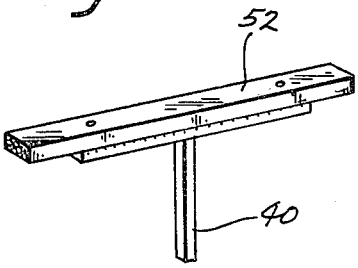
FIG. 5 shows the top support member with a top support surface and an attaching short stem, having attached thereto a two by four for convenient use as a sawhorse.
Figure 6:
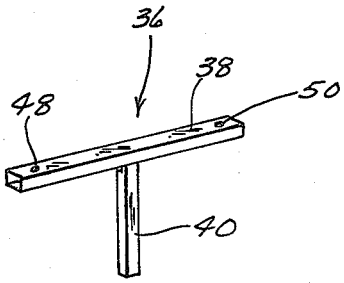
FIG. 6 shows the top support member without anything else attached.

In addition, and as an option, a U-shaped rod gripping member 42 may be rotatably attached to surface 38 by sleeve 44 and set screw 46. Rod member 42 may be moved from an upright position (FIG. 3) to a down, collapsed position (FIG. 4) by simply releasing set screw 46. The rod may be used to support piping structure as depicted in FIG. 1. Alternatively, of course, the rod 42 may be eliminated. Also, top surface 38, adjacent its ends, has threaded apertures 48 and 50 which may be used to secure a plank, or a two by four, as depicted in FIG. 5 at 52.

In actual operation, the device can be stored in collapsed position as shown in FIG. 4, wherein the entire device dwells in a single vertical plane. To set up the device, set screw 22 is released and the top support 36 is pulled upwardly and out. Thereafter, one may grip the shorter attaching members 34 and pull them upwardly and outwardly from sleeves 28 and 30. Shorter attaching members 34 are thereafter inserted into elongatged openings 18 and 20 and set screws 24 and 26 are set. The top support member comprising top surface 38 and the attaching short stem 40 is thereafter inserted, via attaching short stem 40, in telescoping relationship into the open end 16 of stem 12. It is adjusted to the suitable height and set screw 22 is screwed tight to releaseably but securely hold it. The device is now set up as in FIG. 2, and ready for use. Collapsing is accomplished in the reverse order.

It can therefore be seen that a simple, inexpensive and economical work support is provided. One may, of course, utilize one, two or more of such devices 10 as needed to accomplish a particular project. For storage, the device dwells in a single plane as illustrated in FIG. 4, and can conveniently be mounted on a wall or in a cabinet against a back wall for minimum space consumption storage. It is lightweight, portable, height adjustable, and capable of a multitude of uses in a home project. If desired, it can, of course, be used with other elongated rod support members, and attaching clamps to accomplish even more useful support purposes.

It therefore can be seen that the device accomplishes at least all of the stated objectives.

What is claimed is:

1. A collapsible work support comprising:

a "T" shaped frame having a stem portion and a base portion with both the base and stem of the "T" having open ends defining elongated passageways, said "T" shaped frame adjacent each open end having means to releaseably but securely grip any member which telescopes within it;

said "T" stem portion having attached to said stem a pair of holding sleeves for releaseably holding other pieces of said collapsible work support;

a pair of leg supports, each of which has a longer leg member and a shorter attaching member, said attaching members being adapted to telescopically fit within the respective open ends of said base portion of the "T" frame, said longer leg members being adapted to slidably fit within said holding sleeves, a top support member having a top support surface and an attaching short stem which is adapted to telescopically fit into the open end of said stem portion of said "T" shaped frame.

2. The device of claim 1 wherein the means to releaseably but securely grip members which telescope within said elongated passageways are set screws.

3. The device of claim 2 wherein said top surface has an associated abutment grip movable from up to down position.

4. The device of claim 1 wherein said top surface has means bolting a plank thereto.

* * * * *